US008455170B2

(12) United States Patent
Nakamura et al.

(10) Patent No.: US 8,455,170 B2
(45) Date of Patent: Jun. 4, 2013

(54) METHOD FOR PRODUCING ELECTROPHOTOGRAPHIC PHOTOSENSITIVE MEMBER

(75) Inventors: Nobuhiro Nakamura, Mishima (JP); Hideaki Matsuoka, Mishima (JP); Atsushi Fujii, Yokohama (JP); Haruyuki Tsuji, Yokohama (JP); Kazuhisa Shida, Mishima (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 13/409,439

(22) Filed: Mar. 1, 2012

(65) Prior Publication Data

US 2012/0225381 A1 Sep. 6, 2012

(30) Foreign Application Priority Data

Mar. 3, 2011 (JP) ..... 2011-046517
Sep. 29, 2011 (JP) ..... 2011-215136
Feb. 24, 2012 (JP) ..... 2012-039016

(51) Int. Cl.
*G03G 5/04* (2006.01)

(52) U.S. Cl.
USPC ..... 430/127; 430/62

(58) Field of Classification Search
USPC ..... 430/62, 127
See application file for complete search history.

(56) References Cited

U.S. PATENT DOCUMENTS 5,357,320 A 10/1994 Kashimura et al.
5,385,797 A 1/1995 Nagahara et al.
5,422,210 A 6/1995 Maruyama et al.
5,455,135 A 10/1995 Maruyama et al.
5,468,584 A 11/1995 Go et al.
5,485,250 A 1/1996 Kashimura et al.
5,488,461 A 1/1996 Go et al.
5,853,936 A 12/1998 Segi et al.
6,156,472 A 12/2000 Segi et al.
6,773,856 B2 8/2004 Tanaka et al.
7,211,357 B2 5/2007 Hosoi et al.
7,245,851 B2 7/2007 Fujii et al.
7,276,318 B2 10/2007 Fujii et al.
7,333,752 B2 2/2008 Kawahara et al.
7,341,812 B2 * 3/2008 Wu et al. ..... 430/63
7,407,606 B2 8/2008 Chiba et al.
7,517,626 B2 4/2009 Fujii et al.
7,732,113 B2 6/2010 Nakamura et al.
7,910,274 B2 3/2011 Tanaka et al.
8,088,541 B2 1/2012 Tanaka et al.
2012/0114375 A1 5/2012 Fujii et al.
2012/0121291 A1 5/2012 Tsuji et al.

FOREIGN PATENT DOCUMENTS

JP 6-207118 A 7/1994
JP 6-208238 A 7/1994
JP 6-222600 A 8/1994

(Continued)

*Primary Examiner* — Peter Vajda
(74) *Attorney, Agent, or Firm* — Fitzpatrick, Cella, Harper & Scinto

(57) ABSTRACT

An electrophotographic photosensitive member is provided in which black spots on an output image are hardly caused by local charge injection from a support to a photosensitive layer. For this purpose, a conductive layer is formed using a coating liquid for a conductive layer prepared using a solvent, a binder material and a metal oxide particle that satisfies the following relation (i): $45 \leqq A \times \rho \times D \leqq 65$ (i) wherein A denotes the surface area of the metal oxide particle per unit mass [$m^2/g$], D denotes the number average particle diameter of the metal oxide particle [μm], and ρ denotes the density of the metal oxide particle [$g/cm^3$]. The metal oxide particle is a titanium oxide particle coated with tin oxide doped with phosphorus.

3 Claims, 1 Drawing Sheet

FOREIGN PATENT DOCUMENTS

| | | | |
|---|---|---|---|
| JP | 2003-316059 | A | 11/2003 |
| JP | 2004-349167 | A | 12/2004 |
| JP | 2007-47736 | A | 2/2007 |
| WO | 2005/008685 | A1 | 1/2005 |

* cited by examiner

METHOD FOR PRODUCING ELECTROPHOTOGRAPHIC PHOTOSENSITIVE MEMBER

BACKGROUND OF THE INVENTION

1. Field of the Invention

The present invention relates to a method for producing an electrophotographic photosensitive member.

2. Description of the Related Art

Recently, research and development of electrophotographic photosensitive members (organic electrophotographic photosensitive members) using an organic photoconductive material have been performed actively.

The electrophotographic photosensitive member basically includes a support and a photosensitive layer formed on the support. Actually, however, in order to cover defects of the surface of the support, protect the photosensitive layer from electrical damage, improve charging properties, and improve charge injection prohibiting properties from the support to the photosensitive layer, a variety of layers is often provided between the support and the photosensitive layer.

Among the layers provided between the support and the photosensitive layer, as a layer provided to cover defects of the surface of the support, a layer containing metal oxide particles is known. Usually, the layer containing metal oxide particles has a higher conductivity than that of a layer containing no metal oxide particles (for example, volume resistivity of $1.0\times10^{8}$ to $5.0\times10^{12}\Omega\cdot$cm). Accordingly, even if the film thickness of the layer is increased, residual potential is hardly increased at the time of forming an image. For this reason, the defects of the surface of the support are easily covered. Such a highly conductive layer (hereinafter, referred to as a "conductive layer") is provided between the support and the photosensitive layer to cover the defects of the surface of the support. Thereby, the tolerable range of the defects of the surface of the support is wider. As a result, the tolerable range of the support to be used is significantly wider, leading to an advantage in that productivity of the electrophotographic photosensitive member can be improved.

Japanese Patent Application Laid-Open No. H06-222600 discloses a technique in which tin oxide particles doped with phosphorus are used for an intermediate layer provided between a support and a photoconductive layer. Japanese Patent Application Laid-Open No. 2003-316059 discloses a technique in which tin oxide particles doped with tungsten are used for a protective layer provided on a photosensitive layer. Japanese Patent Application Laid-Open No. 2007-047736 discloses a technique in which titanium oxide particles coated with oxygen-defective tin oxide are used for a conductive layer provided between a support and a photosensitive layer. Japanese Patent Application Laid-Open No. H06-208238 discloses a technique in which barium sulfate particles coated with tin oxide are used for an intermediate layer provided between a support and a photosensitive layer.

However, examination by the present inventors has revealed that if an image is repeatedly formed under a high temperature and high humidity environment using an electrophotographic photosensitive member employing the layer containing metal oxide particles described above as a conductive layer, then black spots on the output image are likely to be caused by local charge injection from the support to the photosensitive layer.

SUMMARY OF THE INVENTION

An object of the present invention is to provide a method for producing an electrophotographic photosensitive member in which even if an electrophotographic photosensitive member employs a layer containing metal oxide particles as a conductive layer, black spots on an output image are hardly caused by local charge injection from a support to a photosensitive layer. The present invention is a method for producing an electrophotographic photosensitive member, comprising: a step of forming a conductive layer having a volume resistivity of not less than $1.0\times10^{8}\Omega\cdot$cm but not more than $5.0\times10^{12}\Omega\cdot$cm on a support; and a step of forming a photosensitive layer on the conductive layer, wherein the step of forming the conductive layer comprises: (i) preparing a coating liquid for a conductive layer using a solvent, a binder material, and a metal oxide particle that satisfies the following relation (i): $45\leqq A\times\rho\times D\leqq65$ (i) wherein A denotes the surface area of the metal oxide particle per unit mass [$m^2/g$], D denotes the number average particle diameter of the metal oxide particle [μm], and ρ denotes the density of the metal oxide particle [$g/cm^3$]; and (ii) forming the conductive layer using the coating liquid for a conductive layer, and the metal oxide particle is a titanium oxide particle coated with tin oxide doped with phosphorus.

According to the present invention, even if an electrophotographic photosensitive member employs a layer containing metal oxide particles as a conductive layer, using a specific metal oxide particle that satisfies the above relation (i), an electrophotographic photosensitive member in which black spots on an output image are hardly caused by local charge injection from the support to the photosensitive layer can be produced.

Further features of the present invention will become apparent from the following description of exemplary embodiments with reference to the attached drawings.

DESCRIPTION OF THE EMBODIMENTS

Preferred embodiments of the present invention will now be described in detail in accordance with the accompanying drawings.

An electrophotographic photosensitive member produced by a production method according to the present invention is an electrophotographic photosensitive member including a support, a conductive layer formed on the support, and a photosensitive layer formed on the conductive layer. The photosensitive layer may be a single photosensitive layer in which a charge-generating substance and a charge transport substance are contained in a single layer, or a laminated photosensitive layer in which a charge-generating layer containing a charge-generating substance and a charge transport layer containing a charge transport substance are laminated. Moreover, when necessary, an undercoat layer may be provided between the conductive layer formed on the support and the photosensitive layer.

As the support, those having conductivity (conductive support) can be used, and metallic supports formed with a metal such as aluminum, an aluminum alloy, and stainless steel can be used. In a case where aluminum or an aluminum alloy is used, an aluminum tube produced by a production method comprising extrusion and drawing or an aluminum tube produced by a production method comprising extrusion and ironing can be used. Such an aluminum tube has high precision of the size and surface smoothness without machining the surface, and has an advantage from the viewpoint of cost. However, defects like ragged projections are likely to be produced on the surface of the aluminum tube not machined. Accordingly, provision of the conductive layer is particularly effective.

In the present invention, in order to cover the defects of the surface of the support, the conductive layer having a volume resistivity of not less than $1.0\times10^{8}\Omega\cdot$cm but not more than $5.0\times10^{12}\Omega\cdot$cm is provided on the support. As a layer for covering defects of the surface of the support, if a layer having a volume resistivity of more than $5.0\times10^{12}\Omega\cdot$cm is provided on the support, a flow of charges is likely to stagnate during image formation to increase the residual potential. On the other hand, if the volume resistivity of a conductive layer is less than $1.0\times10^{8}\Omega\cdot$cm, an excessive amount of charges flows in the conductive layer, and black spots on an output image are likely to be caused by local charge injection from the support to the photosensitive layer.

Figure 2:
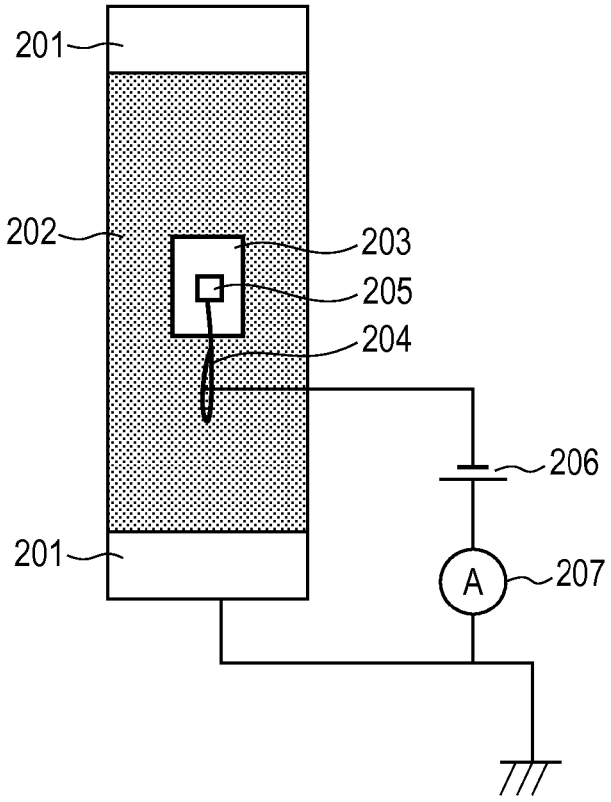
FIG. 2 is a drawing (top view) for describing a method for measuring a volume resistivity of a conductive layer.
Figure 3:
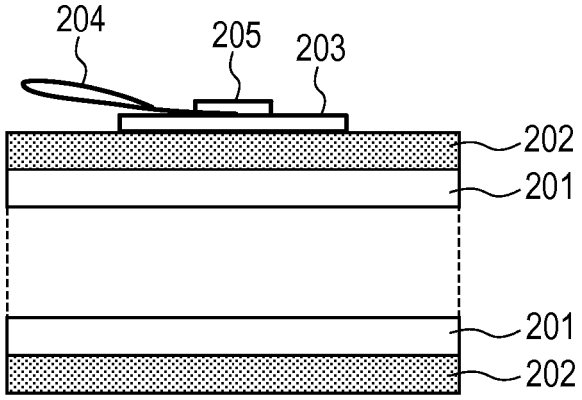
FIG. 3 is a drawing (sectional view) for describing a method for measuring a volume resistivity of a conductive layer.

Using FIG. 2 and FIG. 3, a method for measuring the volume resistivity of the conductive layer in the electrophotographic photosensitive member will be described. FIG. 2 is a top view for describing a method for measuring a volume resistivity of a conductive layer, and FIG. 3 is a sectional view for describing a method for measuring a volume resistivity of a conductive layer.

The volume resistivity of the conductive layer is measured under an environment of normal temperature and normal humidity (23° C./50% RH). A copper tape 203 (made by Sumitomo 3M Limited, No. 1181) is applied to the surface of the conductive layer 202, and the copper tape is used as an electrode on the side of the surface of the conductive layer 202. The support 201 is used as an electrode on a rear surface side of the conductive layer 202. Between the copper tape 203 and the support 201, a power supply 206 for applying voltage, and a current measurement apparatus 207 for measuring the current that flows between the copper tape 203 and the support 201 are provided. In order to apply voltage to the copper tape 203, a copper wire 204 is placed on the copper tape 203, and a copper tape 205 similar to the copper tape 203 is applied onto the copper wire 204 such that the copper wire 204 is not out of the copper tape 203, to fix the copper wire 204 to the copper tape 203. The voltage is applied to the copper tape 203 using the copper wire 204.

The value represented by the following relation (1) is the volume resistivity ρ [Ω·cm] of the conductive layer 202 wherein $I_0$ [A] is a background current value when no voltage is applied between the copper tape 203 and the support 201, I [A] is a current value when −1 V of the voltage having only a DC component is applied, the film thickness of the conductive layer 202 is d [cm], and the area of the electrode (copper tape 203) on the surface side of the conductive layer 202 is S [$cm^2$]:

$$\rho=1/(I-I_0)\times S/d[\Omega\cdot\text{cm}] \quad (1)$$

In this measurement, a slight amount of the current of not more than $1\times10^{-6}$ A in an absolute value is measured. Accordingly, the measurement is preferably performed using a current measurement apparatus 207 that can measure such a slight amount of the current. Examples of such an apparatus include a pA meter (trade name: 4140B) made by Yokogawa Hewlett-Packard Ltd.

The volume resistivity of the conductive layer indicates the same value when the volume resistivity is measured in the state where only the conductive layer is formed on the support and in the state where the respective layers (such as the photosensitive layer) on the conductive layer are removed from the electrophotographic photosensitive member and only the conductive layer is left on the support.

In the present invention, a coating liquid for a conductive layer prepared using a solvent, a binder material, and a metal oxide particle that satisfies the following relation (i) is used for formation of the conductive layer:

$$45\leqq A\times\rho\times D\leqq 65 \quad (i)$$

wherein A: the surface area of the metal oxide particle per unit mass [$m^2$/g]

D: the number average particle diameter of the metal oxide particle [μm], and

ρ: the density of the metal oxide particle [g/$cm^2$].

A coating liquid for a conductive layer can be prepared by dispersing metal oxide particles that satisfy the above relation (i) together with a binder material in a solvent. Examples of a dispersion method include methods using a paint shaker, a sand mill, a ball mill, and a liquid collision type high-speed dispersing machine. The thus-prepared coating liquid for a conductive layer can be applied onto the support, and dried and/or cured to form a conductive layer.

Moreover, in the present invention, as the metal oxide particle above, a titanium oxide ($TiO_2$) particle coated with tin oxide ($SnO_2$) doped with phosphorus (P) as a different element (titanium oxide particle coated with phosphorus-doped tin oxide) is used. In the particle, tin oxide ($SnO_2$) that coats the titanium oxide ($TiO_2$) particle is doped with phosphorus (P) as a different element, thereby to control the resistance of the particle. Usually, doping of tin oxide ($SnO_2$) with phosphorus (P) can reduce the resistance of the particle (powder resistivity, or the like) compared to a case where tin oxide is not doped.

The present inventors found out that the titanium oxide ($TiO_2$) particle coated with tin oxide ($SnO_2$) doped with phosphorus (P) has finer projections and depressions on the surface than titanium oxide ($TiO_2$) particles coated with other metal oxide particle having a different core material particle or a different coating layer (e.g., a titanium oxide ($TiO_2$) particle coated with oxygen-defective tin oxide ($SnO_2$) or a barium sulfate ($BaSO_4$) particle coated with tin oxide ($SnO_2$) doped with phosphorus (P)). Although the detail of the reason is unclear, when the titanium oxide ($TiO_2$) particle coated with tin oxide ($SnO_2$) doped with phosphorus (P) is produced, it is presumed that the process in which the crystal of tin oxide ($SnO_2$) doped with phosphorus (P) is grown on the titanium oxide ($TiO_2$) particle as the core material particle is different from that in other cases.

The present inventors performed extensive examination on the projections and depressions of the surface of the titanium oxide ($TiO_2$) particle coated with tin oxide ($SnO_2$) doped with phosphorus (P). As a result, the present inventors found out that a coating liquid for a conductive layer is prepared using the titanium oxide wherein the specific surface area of the titanium oxide ($TiO_2$) particle coated with tin oxide ($SnO_2$) doped with phosphorus (P) per unit mass is A [$m^2$/g], the density is ρ [g/$cm^3$], the number average particle diameter is D [μm], the product of those, i.e., A×ρ×D is in the range of not less than 45 and not more than 65, and a conductive layer is formed using the coating liquid for a conductive layer; thereby, the occurrence of the black spots on an output image due to local charge injection from the support to the photosensitive layer can be suppressed.

Although the detail of the reason is unclear why the occurrence of the black spots on an output image due to local charge injection from the support to the photosensitive layer can be suppressed in a case where A×ρ×D is in the range of not less than 45 and not more than 65, the present inventors presume as follows.

First, the meaning expressed by A×ρ×D will be described.

The present inventors focused on the fact that the titanium oxide ($TiO_2$) particle coated with tin oxide ($SnO_2$) doped with phosphorus (P) has finer projections and depressions on the surface than those of the surface of other metal oxide particle, and introduced A×ρ×D as an index value that represents the degree of the projections and depressions.

When the density of the particle is ρ [g/cm$^3$], the specific surface area per unit mass is A [m$^2$/g], and the number average particle diameter is D [μm], the specific surface area of the particle per unit volume can be determined as follows:

$$\text{specific surface area per unit volume}[m^2/cm^3] = \text{specific surface area per unit mass } A[m^2/g] \times \text{density } \rho[g/cm^2] \quad (a)$$

The specific surface area of the particle per unit volume is inversely proportional to the particle diameter. Accordingly, A×ρ×D, in which the above relation (a) is multiplied by the number average particle diameter D [μm], can be considered as an index value that represents the degree of the projections and depressions of the surface in consideration of the size and density of the particle. In a case where the particle is a perfect sphere, the solution to A×ρ×D is always 6. It indicates that as A×ρ×D in the particle is a number greater than 6, the spherical object (particle) has finer projections and depressions on the surface than those in the perfect sphere.

In a case where a layer containing metal oxide particles is employed as the conductive layer, a possible mechanism for causing black spots on an output image is that during formation of an image, when the current flows between the metal oxide particles in the conductive layer, the current locally concentrates, and the portion having locally concentrated current appears as the black spot on an output image. In the case of the conductive layer formed using a metal oxide particle having fine projections and depressions on the surface, when the current flows between the metal oxide particles, a conductive path is increased according to an increase in the surface area caused by the projections and depressions, compared to the case of the conductive layer formed using a metal oxide particle having a smooth surface. It is presumed that as a result, a suppressing effect on local concentration of the current is produced, and the occurrence of the black spots on an output image can be suppressed.

In the titanium oxide ($TiO_2$) particle coated with tin oxide ($SnO_2$) doped with phosphorus (P) used for the present invention, the fine crystal of tin oxide ($SnO_2$) doped with phosphorus (P) is grown on the core material particle of the titanium oxide ($TiO_2$) particle to form a coating layer for tin oxide ($SnO_2$) doped with phosphorus (P). For this reason, a particle having finer depressions and projections on the surface can be easily obtained. Compared to this, in a titanium oxide ($TiO_2$) particle coated with oxygen-defective tin oxide ($SnO_2$) and a barium sulfate particle coated with tin oxide ($SnO_2$) doped with phosphorus (P), the crystal of tin oxide ($SnO_2$) is difficult to finely grow on the core material particle, and the depressions and projections of the surface of these particles are rougher than those on the surface of the titanium oxide ($TiO_2$) particle coated with tin oxide ($SnO_2$) doped with phosphorus (P).

As described above, the titanium oxide ($TiO_2$) particle coated with tin oxide ($SnO_2$) doped with phosphorus (P) has finer projections and depressions on the surface than those on the surface of other metal oxide particle. In order to suppress the occurrence of the black spots on an output image caused by local charge injection from the support to the photosensitive layer, however, among such titanium oxide ($TiO_2$) particles coated with tin oxide ($SnO_2$) doped with phosphorus (P), those having particularly fine projections and depressions on the surface need to be used. Specifically, those having A×ρ×D of not less than 45 (45≦A×ρ×D) need to be used, wherein A×ρ×D represents the degree of the projections and depressions.

On the other hand, among the titanium oxide ($TiO_2$) particles coated with tin oxide ($SnO_2$) doped with phosphorus (P), in a case where those having a value of A×ρ×D of more than 65 are used, the depressions and projections of the surface of the particle are excessively fine, and the depressions and projections of the surface are difficult to keep during preparation of the coating liquid for a conductive layer. As a result, the coating layer formed with tin oxide ($SnO_2$) doped with phosphorus (P) on the core material particle is broken, or the dispersing state of the particles in the coating liquid for a conductive layer becomes unstable, leading an insufficient suppressing effect on the black spots. Accordingly, the titanium oxide ($TiO_2$) particles having a value of A×ρ×D of not more than 65 (A×ρ×D≦65) need to be used. Particularly, those having a value of A×ρ×D of not more than 55 (A×ρ×D≦55) are preferable.

In order to control the value of A×ρ×D of the titanium oxide ($TiO_2$) particle coated with tin oxide ($SnO_2$) doped with phosphorus (P), for example, the proportion (coverage, the thickness of the coating layer) of tin oxide ($SnO_2$) in the titanium oxide ($TiO_2$) particle coated with tin oxide ($SnO_2$) doped with phosphorus (P), the number average particle diameter D, and the baking conditions may be adjusted. The coverage is a proportion of tin oxide ($SnO_2$) in the titanium oxide ($TiO_2$) particle coated with tin oxide ($SnO_2$) doped with phosphorus (P). The thickness of the coating layer is a thickness of the coating layer of tin oxide ($SnO_2$) doped with phosphorus (P). Examples of the baking conditions include baking temperature and baking time. As the coverage and the thickness of the coating layer are larger, tin oxide ($SnO_2$) in the coating layer formed on the surface of titanium oxide ($TiO_2$) (core material particle) is layered and the projections and depressions of the surface of the particle are finer. As a result, the value of A×ρ×D is larger. Moreover, as the baking temperature is lower, the projections and depressions of the surface of the particle are finer, and the value of A×ρ×D is larger. Conversely, as the baking temperature is higher, the value of A×ρ×D is smaller. Moreover, as the baking time is shorter, the projections and depressions of the surface of the particle are finer, and the value of A×ρ×D is larger. Conversely, as the baking time is longer, the value of A×ρ×D is smaller.

In order to control the coverage and thickness of the coating layer of tin oxide ($SnO_2$), when the titanium oxide ($TiO_2$) particle coated with tin oxide ($SnO_2$) doped with phosphorus (P) is produced, a tin raw material needed to produce tin oxide ($SnO_2$) needs to be blended. For example, in a case where tin chloride ($SnCl_4$) is used as the tin raw material, preparation is necessary in consideration of the amount of tin oxide ($SnO_2$) to be produced from tin chloride ($SnCl_4$). In the present invention, although tin oxide ($SnO_2$) is doped with phosphorus (P), the coverage is a value calculated using the mass of tin oxide ($SnO_2$) based on the total mass of tin oxide ($SnO_2$) and titanium oxide ($TiO_2$) without considering the mass of phosphorus (P) with which tin oxide ($SnO_2$) is doped. The coverage is preferably 10 to 60% by mass. At a coverage of tin oxide ($SnO_2$) less than 10% by mass, it is difficult to coat the whole surface of titanium oxide ($TiO_2$) particle (core material particle) with tin oxide ($SnO_2$) doped with phosphorus (P). At a coverage more than 60% by mass, coating of the titanium oxide ($TiO_2$) particle (core material particle) with tin oxide ($SnO_2$) doped with phosphorus (P) is likely to become uneven, and cost is likely to increase. The thickness of the coating layer is preferably 5 to 40 nm.

The amount of phosphorus (P) with which tin oxide ($SnO_2$) is doped is preferably 0.1 to 10% by mass based on the mass of tin oxide ($SnO_2$) (the mass not including phosphorus (P)). If the amount of phosphorus (P) with which tin oxide ($SnO_2$) is doped is less than 0.1% by mass, the powder resistivity of the particle is difficult to sufficiently reduce, and the volume resistivity of the conductive layer is difficult to adjust in the range of not more than $5.0\times10^{12}\Omega\cdot$cm. If the amount of phosphorus (P) with which tin oxide ($SnO_2$) is doped is more than 10% by mass, crystallinity of tin oxide ($SnO_2$) is likely to be reduced. Usually, doping of tin oxide ($SnO_2$) with phosphorus (P) can reduce the powder resistivity of the particle, compared to a case where tin oxide is not doped.

The method for producing titanium oxide ($TiO_2$) particles coated with tin oxide ($SnO_2$) doped with phosphorus (P) is disclosed in Japanese Patent Application Laid-Open No. H06-207118, Japanese Patent Application Laid-Open No. 2004-349167, and WO2005/008685.

The number average particle diameter D [μm] of the titanium oxide ($TiO_2$) particle coated with tin oxide ($SnO_2$) doped with phosphorus (P) is preferably not less than 0.10 μm and not more than 0.30 μm ($0.10\leqq D\leqq 0.30$), and more preferably not less than 0.13 μm but not more than 0.25 μm ($0.13\leqq D\leqq 0.25$). If the number average particle diameter D [μm] is excessively small, the titanium oxide ($TiO_2$) particles coated with tin oxide ($SnO_2$) doped with phosphorus (P) may aggregate again in the coating liquid for a conductive layer, leading to deterioration of the stability of the coating liquid for a conductive layer or cracks produced on the surface of the conductive layer to be formed. On the other hand, if the number average particle diameter D [μm] is excessively large, the surface of the conductive layer to be formed is likely to be rough.

In the present invention, the number average particle diameter D [μm] of the metal oxide particle (titanium oxide ($TiO_2$) particle coated with tin oxide ($SnO_2$) doped with phosphorus (P)) was determined using a scanning electron microscope as follows. Using a scanning electron microscope (trade name: S-4800) made by Hitachi, Ltd., the particles to be measured were observed. From the image obtained by observation, each particle diameter of 100 titanium oxide ($TiO_2$) particles coated with tin oxide ($SnO_2$) doped with phosphorus (P) was measured, and an arithmetic average of these was calculated to obtain the number average particle diameter D [μm]. Each particle diameter was (a+b)/2 wherein the longest side of the primary particle was a, and the shortest side thereof was b.

In the present invention, the specific surface area per unit mass A [$m^2$/g] of the metal oxide particle (titanium oxide ($TiO_2$) particle coated with tin oxide ($SnO_2$) doped with phosphorus (P)) was determined using the BET method as follows. Using a specific surface area analyzer (trade name: Gemini 2375 Ver.5.0) made by SHIMADZU Corporation, nitrogen gas was adsorbed onto the surfaces of the particles to be measured, and the specific surface area per unit mass (BET specific surface area) A [$m^2$/g] was calculated using a BET multi-point method.

In the present invention, the density ρ [g/$cm^3$] of the metal oxide particle (titanium oxide ($TiO_2$) particle coated with tin oxide ($SnO_2$) doped with phosphorus (P)) was determined using a dry-type automatic densimeter as follows. Using a dry-type automatic densimeter (trade name: Accupyc 1330) made by SHIMADZU Corporation, and a container having a volume of 10 $cm^3$, the particles to be measured were purged with helium gas at the maximum pressure of 19.5 psig 10 times as a pre-treatment. Subsequently, for a value for determining the pressure equilibrium that indicates whether or not the inner pressure of the container achieves a state of equilibrium, the fluctuation of the inner pressure of the sample chamber of 0.0050 psig/min was used as an index. At a value not more than 0.0050 psig/min, the state of equilibrium was considered to be achieved, and the measurement was started. The density ρ [g/$cm^3$] was automatically measured.

Examples of a binder material used for preparation of the coating liquid for a conductive layer include resins such as phenol resins, polyurethanes, polyamides, polyimides, polyamidimides, polyvinyl acetals, epoxy resins, acrylic resins, melamine resins, and polyesters. One of these or two or more thereof can be used. Among these resins, curable resins are preferable and thermosetting resins are more preferable from the viewpoint of suppressing migration (transfer) to other layer, adhesive properties to the support, the dispersibility and dispersion stability of the titanium oxide ($TiO_2$) particle coated with tin oxide ($SnO_2$) doped with phosphorus (P), and resistance against a solvent after formation of the layer. Among the thermosetting resins, thermosetting phenol resins and thermosetting polyurethanes are preferable. In a case where a curable resin is used for the binder material for the conductive layer, the binder material contained in the coating liquid for a conductive layer is a monomer and/or oligomer of the curable resin.

Examples of a solvent used for the coating liquid for a conductive layer include alcohols such as methanol, ethanol, and isopropanol; ketones such as acetone, methyl ethyl ketone, and cyclohexanone; ethers such as tetrahydrofuran, dioxane, ethylene glycol monomethyl ether, and propylene glycol monomethyl ether; esters such as methyl acetate and ethyl acetate; and aromatic hydrocarbons such as toluene and xylene.

In the present invention, the mass ratio (P/B) of the metal oxide particle (titanium oxide ($TiO_2$) particle coated with tin oxide ($SnO_2$) doped with phosphorus (P)) (P) to the binder material (B) in the coating liquid for a conductive layer is preferably not less than 1.5/1.0 and not more than 3.5/1.0. If the mass ratio (P/B) of the metal oxide particle (titanium oxide ($TiO_2$) particle coated with tin oxide ($SnO_2$) doped with phosphorus (P)) (P) to the binder material (B) is less than 1.5/1.0, it is difficult to adjust the volume resistivity of the conductive layer in the range of not more than $5.0\times10^{12}\Omega\cdot$cm. If the mass ratio (P/B) of the metal oxide particle (titanium oxide ($TiO_2$) particle coated with tin oxide ($SnO_2$) doped with phosphorus (P)) (P) to the binder material (B) is more than 3.5/1.0, it is difficult to adjust the volume resistivity of the conductive layer in the range of not less than $1.0\times10^{8}\Omega\cdot$cm. Moreover, the metal oxide particle (titanium oxide ($TiO_2$) particle coated with tin oxide ($SnO_2$) doped with phosphorus (P)) is difficult to bind, and cracks are likely to be produced in the conductive layer.

From the viewpoint of covering the defects of the surface of the support, the film thickness of the conductive layer is preferably not less than 10 μm but not more than 40 μm, and more preferably not less than 15 μm but not more than 35 μm.

In the present invention, FISCHERSCOPE MMS made by Helmut Fischer GmbH was used as an apparatus for measuring the film thickness of each layer in the electrophotographic photosensitive member including a conductive layer.

In order to suppress interference fringes produced on the output image by interference of the light reflected on the surface of the conductive layer, the coating liquid for a conductive layer may contain a surface roughening material for roughening the surface of the conductive layer. As the surface roughening material, resin particles having the average particle diameter of not less than 1 μm and not more than 5 μm are preferable. Examples of the resin particles include particles of curable resins such as curable rubbers, polyurethanes, epoxy resins, alkyd resins, phenol resins, polyesters, silicone resins, and acrylic-melamine resins. Among these, particles of silicone resins difficult to aggregate are preferable. The specific gravity of the resin particle (0.5 to 2) is smaller than that of the titanium oxide ($TiO_2$) particle coated with tin oxide ($SnO_2$) doped with phosphorus (P) (4 to 7). For this reason, the surface of the conductive layer is efficiently roughened at the time of forming the conductive layer. However, as the content of the surface roughening material in the conductive layer is larger, the volume resistivity of the conductive layer is likely to be increased. Accordingly, in order to adjust the volume resistivity of the conductive layer in the range of not more than $5.0\times10^{12}\Omega\cdot$cm, the content of the surface roughening material in the coating liquid for a conductive layer is preferably 1 to 80% by mass based on the binder material in the coating liquid for a conductive layer.

The coating liquid for a conductive layer may also contain a leveling agent for increasing surface properties of the conductive layer. The coating liquid for a conductive layer may also contain pigment particles for improving covering properties to the conductive layer.

In order to prevent charge injection from the conductive layer to the photosensitive layer, an undercoat layer (barrier layer) having electrical barrier properties may be provided between the conductive layer and the photosensitive layer.

The undercoat layer can be formed by applying a coating solution for an undercoat layer containing a resin (binder resin) onto the conductive layer, and drying the applied solution.

Examples of the resin (binder resin) used for the undercoat layer include water soluble resins such as polyvinyl alcohol, polyvinyl methyl ether, polyacrylic acids, methyl cellulose, ethyl cellulose, polyglutamic acid, casein, and starch, polyamides, polyimides, polyamidimides, polyamic acids, melamine resins, epoxy resins, polyurethanes, and polyglutamic acid esters. Among these, in order to produce electrical barrier properties of the undercoat layer effectively, thermoplastic resins are preferable. Among the thermoplastic resins, thermoplastic polyamides are preferable. As polyamides, copolymerized nylons are preferable.

The film thickness of the undercoat layer is preferably not less than 0.1 μm but not more than 2 μm.

In order to prevent a flow of charges from stagnating in the undercoat layer, the undercoat layer may contain an electron transport substance (electron-receptive substance such as an acceptor). Examples of the electron transport substance include electron-withdrawing substances such as 2,4,7-trinitrofluorenone, 2,4,5,7-tetranitrofluorenone, chloranil, and tetracyanoquinodimethane, and polymerized products of these electron-withdrawing substances.

On the conductive layer (undercoat layer), the photosensitive layer is provided.

Examples of the charge-generating substance used for the photosensitive layer include azo pigments such as monoazos, disazos, and trisazos; phthalocyanine pigments such as metal phthalocyanine and non-metallic phthalocyanine; indigo pigments such as indigo and thioindigo; perylene pigments such as perylene acid anhydrides and perylene acid imides; polycyclic quinone pigments such as anthraquinone and pyrenequinone; squarylium dyes; pyrylium salts and thiapyrylium salts; triphenylmethane dyes; quinacridone pigments; azulenium salt pigments; cyanine dyes; xanthene dyes; quinonimine dyes; and styryl dyes. Among these, metal phthalocyanines such as oxytitanium phthalocyanine, hydroxy gallium phthalocyanine, and chlorogallium phthalocyanine are preferable.

In a case where the photosensitive layer is a laminated photosensitive layer, a coating solution for a charge-generating layer prepared by dispersing a charge-generating substance and a binder resin in a solvent can be applied and dried to form a charge-generating layer. Examples of the dispersion method include methods using a homogenizer, an ultrasonic wave, a ball mill, a sand mill, an attritor, or a roll mill.

Examples of the binder resin used for the charge-generating layer include polycarbonates, polyesters, polyarylates, butyral resins, polystyrenes, polyvinyl acetals, diallyl phthalate resins, acrylic resins, methacrylic resins, vinyl acetate resins, phenol resins, silicone resins, polysulfones, styrene-butadiene copolymers, alkyd resins, epoxy resins, urea resins, and vinyl chloride-vinyl acetate copolymers. One of these can be used alone, or two or more thereof can be used as a mixture or a copolymer.

The proportion of the charge-generating substance to the binder resin (charge-generating substance:binder resin) is preferably in the range of 10:1 to 1:10 (mass ratio), and more preferably in the range of 5:1 to 1:1 (mass ratio).

Examples of the solvent used for the coating solution for a charge-generating layer include alcohols, sulfoxides, ketones, ethers, esters, aliphatic halogenated hydrocarbons, and aromatic compounds.

The film thickness of the charge-generating layer is preferably not more than 5 μm, and more preferably not less than 0.1 μm but not more than 2 μm.

To the charge-generating layer, a variety of additives such as a sensitizer, an antioxidant, an ultraviolet absorbing agent, and a plasticizer can be added when necessary. In order to prevent a flow of charges from stagnating in the charge-generating layer, the charge-generating layer may contain an electron transport substance (an electron-receptive substance such as an acceptor). Examples of the electron transport substance include electron-withdrawing substances such as 2,4,7-trinitrofluorenone, 2,4,5,7-tetranitrofluorenone, chloranil, and tetracyanoquinodimethane, and polymerized products of these electron-withdrawing substances.

Examples of the charge transport substance used for the photosensitive layer include triarylamine compounds, hydrazone compounds, styryl compounds, stilbene compounds, pyrazoline compounds, oxazole compounds, thiazole compounds, and triallylmethane compounds.

In a case where the photosensitive layer is a laminated photosensitive layer, a coating solution for a charge transport layer prepared by dissolving the charge transport substance and a binder resin in a solvent can be applied and dried to form a charge transport layer.

Examples of the binder resin used for the charge transport layer include acrylic resins, styrene resins, polyesters, polycarbonates, polyarylates, polysulfones, polyphenylene oxides, epoxy resins, polyurethanes, alkyd resins, and unsaturated resins. One of these can be used alone, or two or more thereof can be used as a mixture or a copolymer.

The proportion of the charge transport substance to the binder resin (charge transport substance:binder resin) is preferably in the range of 2:1 to 1:2 (mass ratio).

Examples of the solvent used for the coating solution for a charge transport layer include ketones such as acetone and methyl ethyl ketone; esters such as methyl acetate and ethyl acetate; ethers such as dimethoxymethane and dimethoxyethane; aromatic hydrocarbons such as toluene and xylene; and hydrocarbons substituted by a halogen atom such as chlorobenzene, chloroform, and carbon tetrachloride.

From the viewpoint of charging uniformity and reproductivity of an image, the film thickness of the charge transport layer is preferably not less than 3 μm but not more than 40 μm, and more preferably not less than 4 μm but not more than 30 μm.

To the charge transport layer, an antioxidant, an ultraviolet absorbing agent, and a plasticizer can be added when necessary.

In a case where the photosensitive layer is a single photosensitive layer, a coating solution for a single photosensitive layer containing a charge-generating substance, a charge transport substance, a binder resin, and a solvent can be applied and dried to form a single photosensitive layer. As the charge-generating substance, the charge transport substance, the binder resin, and the solvent, a variety of the materials described above can be used, for example.

On the photosensitive layer, a protective layer may be provided to protect the photosensitive layer.

A coating solution for a protective layer containing a resin (binder resin) can be applied and dried and/or cured to form a protective layer.

The film thickness of the protective layer is preferably not less than 0.5 μm but not more than 10 μm, and more preferably not less than 1 μm but not more than 8 μm.

In application of the coating solutions for the respective layers above, application methods such as a dip coating method (an immersion coating method), a spray coating method, a spin coating method, a roll coating method, a Meyer bar coating method, and a blade coating method can be used.

Figure 1:
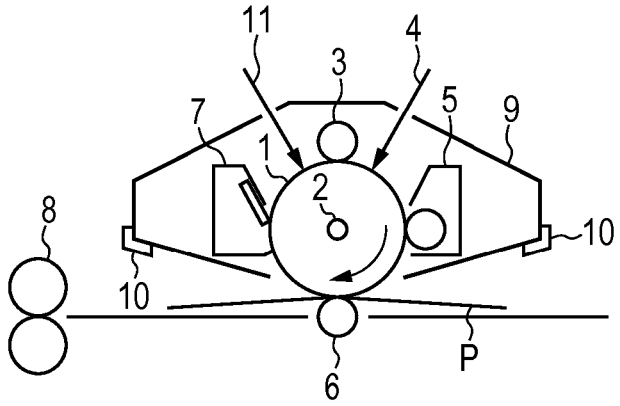
FIG. 1 is a drawing illustrating an example of a schematic configuration of an electrophotographic apparatus including a process cartridge having an electrophotographic photosensitive member.

FIG. 1 illustrates an example of a schematic configuration of an electrophotographic apparatus including a process cartridge having an electrophotographic photosensitive member.

In FIG. 1, a drum type electrophotographic photosensitive member 1 is rotated and driven around a shaft 2 in the arrow direction at a predetermined circumferential speed.

The circumferential surface of the electrophotographic photosensitive member 1 rotated and driven is uniformly charged at a predetermined positive or negative potential by a charging unit (a primary charging unit, a charging roller, or the like) 3. Next, the circumferential surface of the electrophotographic photosensitive member 1 receives exposure light (image exposure light) 4 output from an exposing unit such as slit exposure or laser beam scanning exposure (not illustrated). Thus, an electrostatic latent image corresponding to a target image is sequentially formed on the circumferential surface of the electrophotographic photosensitive member 1. The voltage applied to the charging unit 3 may be only DC voltage, or DC voltage on which AC voltage is superimposed.

The electrostatic latent image formed on the circumferential surface of the electrophotographic photosensitive member 1 is developed by a toner of a developing unit 5 to form a toner image. Next, the toner image formed on the circumferential surface of the electrophotographic photosensitive member 1 is transferred onto a transfer material (such as paper) P by a transfer bias from a transferring unit (such as a transfer roller) 6. The transfer material P is fed from a transfer material feeding unit (not illustrated) between the electrophotographic photosensitive member 1 and the transferring unit 6 (contact region) in synchronization with rotation of the electrophotographic photosensitive member 1.

The transfer material P having the toner image transferred is separated from the circumferential surface of the electrophotographic photosensitive member 1, and introduced to a fixing unit 8 to fix the image. Thereby, an image forming product (print, copy) is printed out of the apparatus.

From the circumferential surface of the electrophotographic photosensitive member 1 after transfer of the toner image, the remaining toner of transfer is removed by a cleaning unit (such as a cleaning blade) 7. Further, the circumferential surface of the electrophotographic photosensitive member 1 is discharged by pre-exposure light 11 from a pre-exposing unit (not illustrated), and is repeatedly used for image formation. In a case where the charging unit is a contact charging unit such as a charging roller, the pre-exposure is not always necessary.

The electrophotographic photosensitive member 1 and at least one component selected from the charging unit 3, the developing unit 5, the transferring unit 6, and the cleaning unit 7 may be accommodated in a container and integrally supported as a process cartridge, and the process cartridge may be detachably attached to the main body of the electrophotographic apparatus. In FIG. 1, the electrophotographic photosensitive member 1, the charging unit 3, the developing unit 5, and the cleaning unit 7 are integrally supported to form a process cartridge 9, which is detachably attached to the main body of the electrophotographic apparatus using a guide unit 10 such as a rail in the main body of the electrophotographic apparatus. Moreover, the electrophotographic apparatus may include the electrophotographic photosensitive member 1, the charging unit 3, the exposing unit, the developing unit 5, and the transferring unit 6.

Hereinafter, using specific Examples, the present invention will be described more in detail. However, the present invention will not be limited to these. In Examples, "parts" mean "parts by mass." The titanium oxide ($TiO_2$) particle (core material particle) in the titanium oxide ($TiO_2$) particle coated with tin oxide ($SnO_2$) doped with phosphorus (P) used in Examples is spherical.

<Preparation Example of Coating Liquid for a Conductive Layer>

In coating liquids for a conductive layer 1 to 81, a titanium oxide ($TiO_2$) particle coated with tin oxide ($SnO_2$) doped with phosphorus (P) having a coverage of 10 to 60% by mass was used.

(Preparation Example of Coating Liquid for a Conductive Layer 1)

220 parts of the titanium oxide ($TiO_2$) particle coated with tin oxide ($SnO_2$) doped with phosphorus (P) as the metal oxide particle (coverage: 30% by mass, surface area A per unit mass: 87.5 $m^2/g$, number average particle diameter D: 0.10 μm, density ρ: 4.7 $g/cm^3$, $A \times \rho \times D = 41$), 122 parts of a phenol resin as the binder material (trade name: Plyophen J-325, made by DIC Corporation, resin solid content: 60% by mass), and 98 parts of 1-methoxy-2-propanol as the solvent were placed in a sand mill using glass beads having a diameter of 1 mm, and dispersed under conditions: rotational speed, 2000 rpm; and dispersion time, 3 hours, to obtain a dispersion liquid.

The glass beads were removed from the dispersion liquid with a mesh. Then, to the dispersion liquid, 13.8 parts of silicone resin particles as the surface roughening material (trade name: Tospearl 120, made by Momentive Performance Materials Inc., average particle diameter: 2 μm), 0.014 parts of silicone oil as the leveling agent (trade name: SH28PA, made by Dow Corning Toray Co., Ltd.), 6 parts of methanol, and 6 parts of 1-methoxy-2-propanol were added and stirred to prepare a coating liquid for a conductive layer 1.

(Preparation Examples of Coating Liquids for a Conductive Layer 2 to 81 and C1 to C60)

Coating liquids for a conductive layer 2 to 81 and C1 to C60 were prepared by the same operation as that in Preparation Example of the coating liquid for a conductive layer 1 except that the kind and amount of the metal oxide particle used for preparation of the coating liquid for a conductive layer and the amount of the phenol resin as the binder material were changed as shown in Tables 1 to 5.

<Production Examples of Electrophotographic Photosensitive Member>

(Production Example of Electrophotographic Photosensitive Member 1)

A support was an aluminum cylinder having a length of 246 mm and a diameter of 24 mm and produced by a production method including extrusion and drawing (JIS-A3003, aluminum alloy).

Under an environment of normal temperature and normal humidity (23° C./60% RH), the coating liquid for a conductive layer 1 was applied onto the support by dip coating, and dried and thermally cured for 30 minutes at 140° C. to form a conductive layer 1 having a film thickness of 30 μm. The volume resistivity of the conductive layer 1 was measured by the method described above, and it was $1.0\times10^{8}\Omega\cdot$cm.

Next, 4.5 parts of N-methoxymethylated nylon (trade name: TORESIN EF-30T, made by Nagase ChemteX Corporation) and 1.5 parts of a copolymerized nylon resin (trade name: AMILAN CM8000, made by Toray Industries, Inc.) were dissolved in a mixed solvent of 65 parts of methanol/30 parts of n-butanol to prepare a coating solution for an undercoat layer. The coating solution for an undercoat layer was applied onto the conductive layer by dip coating, and dried for 6 minutes at 70° C. to form an undercoat layer having a film thickness of 0.85 μm.

Next, 10 parts of crystalline hydroxy gallium phthalocyanine crystals (charge-generating substance) having strong peaks at Bragg angles (2θ±0.2°) of 7.5°, 9.9°, 16.3°, 18.6°, 25.1°, and 28.3° in CuKα properties X ray diffraction, 5 parts of polyvinyl butyral (trade name: S-LECBX-1, made by Sekisui Chemical Co., Ltd.), and 250 parts of cyclohexanone were placed in a sand mill using glass beads having a diameter of 0.8 mm. The solution was dispersed under a condition: dispersing time, 3 hours. Next, 250 parts of ethyl acetate was added to the solution to prepare a coating solution for a charge-generating layer. The coating solution for a charge-generating layer was applied onto the undercoat layer by dip coating, and dried for 10 minutes at 100° C. to form a charge-generating layer having a film thickness of 0.12 μm.

Next, 4.8 parts of an amine compound (charge transport substance) represented by the following formula (CT-1):

(CT-1)

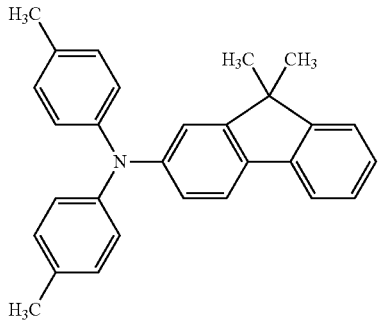

3.2 parts of an amine compound (charge transport substance) represented by the following formula (CT-2):

(CT-2)

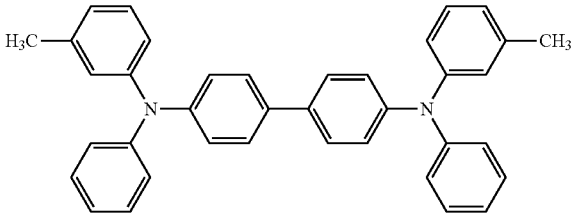

and 10 parts of polycarbonate (trade name: Z200, made by Mitsubishi Engineering-Plastics Corporation) were dissolved in a mixed solvent of 30 parts of dimethoxymethane/70 parts of chlorobenzene to prepare a coating solution for a charge transport layer. The coating solution for a charge transport layer was applied onto the charge-generating layer by dip coating, and dried for 30 minutes at 110° C. to form a charge transport layer having a film thickness of 8.0 μm.

Thus, an electrophotographic photosensitive member 1 was produced.

(Production Examples of Electrophotographic Photosensitive Members 2 to 81 and C1 to C60)

Electrophotographic photosensitive members 2 to and C1 to C60 were produced by the same operation as that in Production Example of the electrophotographic photosensitive member 1 except that the coating liquid for a conductive layer used in production of the electrophotographic photosensitive member was changed from the coating liquid for a conductive layer 1 to the coating liquids for a conductive layer 2 to 81 and C1 to C60, respectively. The volume resistivity of a conductive layer in the electrophotographic photosensitive members 2 to 81 and C1 to C60 was measured by the same method as that in the case of the conductive layer of the electrophotographic photosensitive member 1. The result is shown in Tables 1 to 5. In Tables 1 to 5, tin oxide is "$SnO_2$," and titanium oxide is "$TiO_2$."

TABLE 1

| Electro-photographic photosensitive member | Coating solution for conductive layer | Metal oxide particle Kind | A [m²/g] | ρ [g/cm³] | D [μm] | A × ρ × D | Amount [parts] | Binder material (phenol resin) Amount [parts] (resin solid content is 60% by mass of amount below) | Volume resistivity of conductive layer [Ω · cm] |
|---|---|---|---|---|---|---|---|---|---|
| 1 | 1 | Titanium | 87.5 | 4.7 | 0.10 | 41 | 220 | 122 | $1.0\times10^{8}$ |
| 2 | 2 | oxide | 88.2 | 4.7 | 0.10 | 41 | 214 | 132 | $1.0\times10^{10}$ |
| 3 | 3 | particle | 86.3 | 4.8 | 0.10 | 41 | 202 | 153 | $5.0\times10^{12}$ |
| 4 | 4 | coated with | 129.0 | 5.0 | 0.10 | 65 | 220 | 122 | $1.0\times10^{8}$ |
| 5 | 5 | tin oxide | 127.0 | 5.1 | 0.10 | 65 | 212 | 136 | $4.0\times10^{10}$ |
| 6 | 6 | doped with | 129.4 | 5.0 | 0.10 | 65 | 202 | 153 | $5.0\times10^{12}$ |
| 7 | 7 | phosphorus | 29.0 | 4.7 | 0.30 | 41 | 218 | 126 | $1.0\times10^{8}$ |
| 8 | a | | 28.8 | 4.7 | 0.30 | 41 | 212 | 136 | $1.0\times10^{10}$ |
| 9 | 9 | | 28.7 | 4.8 | 0.30 | 41 | 202 | 153 | $5.0\times10^{12}$ |
| 10 | 10 | | 42.2 | 5.1 | 0.30 | 65 | 220 | 122 | $1.0\times10^{8}$ |
| 11 | 11 | | 42.5 | 5.1 | 0.30 | 65 | 214 | 132 | $1.0\times10^{10}$ |

TABLE 1-continued

| Electro-photographic photosensitive member | Coating solution for conductive layer | Metal oxide particle Kind | A [$m^2/g$] | ρ [$g/cm^3$] | D [μm] | A × ρ × D | Amount [parts] | Binder material (phenol resin) Amount [parts] (resin solid content is 60% by mass of amount below) | Volume resistivity of conductive layer [Ω · cm] |
|---|---|---|---|---|---|---|---|---|---|
| 12 | 12 | | 42.3 | 5.1 | 0.30 | 65 | 198 | 157 | $5.0 \times 10^{12}$ |
| 13 | 13 | | 69.1 | 4.6 | 0.13 | 41 | 216 | 129 | $1.0 \times 10^{8}$ |
| 14 | 14 | | 67.5 | 4.7 | 0.13 | 41 | 214 | 132 | $2.0 \times 10^{10}$ |
| 15 | 15 | | 67.1 | 4.7 | 0.13 | 41 | 202 | 153 | $5.0 \times 10^{12}$ |
| 16 | 16 | | 102.0 | 4.9 | 0.13 | 65 | 220 | 122 | $1.0 \times 10^{8}$ |
| 17 | 17 | | 99.9 | 5.0 | 0.13 | 65 | 212 | 136 | $1.0 \times 10^{10}$ |
| 18 | 18 | | 97.6 | 5.1 | 0.13 | 65 | 202 | 153 | $5.0 \times 10^{12}$ |
| 19 | 19 | | 55.1 | 4.7 | 0.16 | 41 | 220 | 122 | $1.0 \times 10^{8}$ |
| 20 | 20 | | 55.9 | 4.6 | 0.16 | 41 | 214 | 132 | $1.0 \times 10^{10}$ |
| 21 | 21 | | 56.2 | 4.6 | 0.16 | 41 | 202 | 153 | $5.0 \times 10^{12}$ |
| 22 | 22 | | 81.0 | 5.0 | 0.16 | 65 | 220 | 122 | $1.0 \times 10^{8}$ |
| 23 | 23 | | 82.5 | 4.9 | 0.16 | 65 | 212 | 136 | $1.0 \times 10^{10}$ |
| 24 | 24 | | 80.7 | 5.0 | 0.16 | 65 | 207 | 144 | $5.0 \times 10^{12}$ |
| 25 | 24 | | 39.9 | 4.7 | 0.22 | 41 | 224 | 115 | $1.0 \times 10^{8}$ |
| 26 | 26 | | 39.5 | 4.7 | 0.22 | 41 | 214 | 132 | $2.0 \times 10^{10}$ |
| 27 | 27 | | 40.0 | 4.7 | 0.22 | 41 | 198 | 157 | $5.0 \times 10^{12}$ |
| 28 | 28 | | 55.1 | 4.9 | 0.22 | 59 | 212 | 136 | $1.0 \times 10^{10}$ |
| 29 | 29 | | 59.0 | 5.0 | 0.22 | 65 | 220 | 122 | $1.0 \times 10^{8}$ |
| 30 | 30 | | 58.7 | 5.0 | 0.22 | 65 | 214 | 132 | $1.0 \times 10^{10}$ |

TABLE 2

| Electro-photographic photosensitive member | Coating solution for conductive layer | Metal oxide particle Kind | A [$m^2/g$] | ρ [$g/cm^3$] | D [μm] | A × ρ × D | Amount [parts] | Binder material (phenol resin) Amount [parts] (resin solid content is 60% by mass of amount below) | Volume resistivity of conductive layer [Ω · cm] |
|---|---|---|---|---|---|---|---|---|---|
| 31 | 31 | Titanium | 57.7 | 5.1 | 0.22 | 65 | 198 | 157 | $5.0 \times 10^{12}$ |
| 32 | 32 | oxide | 35.0 | 4.7 | 0.25 | 41 | 220 | 122 | $1.0 \times 10^{8}$ |
| 33 | 33 | particle | 35.9 | 4.6 | 0.25 | 41 | 214 | 132 | $2.0 \times 10^{10}$ |
| 34 | 34 | coated with | 35.7 | 4.6 | 0.25 | 41 | 198 | 157 | $5.0 \times 10^{12}$ |
| 35 | 35 | tin oxide | 50.8 | 5.1 | 0.25 | 65 | 220 | 122 | $1.0 \times 10^{8}$ |
| 36 | 36 | doped with | 50.8 | 5.1 | 0.25 | 65 | 214 | 132 | $1.0 \times 10^{10}$ |
| 37 | 37 | phosphorus | 51.6 | 5.0 | 0.25 | 65 | 198 | 157 | $5.0 \times 10^{12}$ |
| 38 | 38 | | 96.0 | 4.7 | 0.10 | 45 | 224 | 115 | $1.0 \times 10^{8}$ |
| 39 | 39 | | 96.2 | 4.7 | 0.10 | 45 | 214 | 132 | $4.0 \times 10^{10}$ |
| 40 | 40 | | 94.1 | 4.8 | 0.10 | 45 | 198 | 157 | $5.0 \times 10^{12}$ |
| 41 | 41 | | 104.5 | 4.8 | 0.10 | 50 | 214 | 132 | $4.0 \times 10^{10}$ |
| 42 | 42 | | 111.3 | 4.9 | 0.10 | 55 | 224 | 115 | $2.0 \times 10^{8}$ |
| 43 | 43 | | 109.0 | 5.0 | 0.10 | 55 | 214 | 132 | $2.0 \times 10^{10}$ |
| 44 | 44 | | 112.0 | 4.9 | 0.10 | 55 | 202 | 153 | $5.0 \times 10^{12}$ |
| 45 | 45 | | 32.0 | 4.7 | 0.30 | 45 | 224 | 115 | $1.0 \times 10^{8}$ |
| 46 | 46 | | 31.9 | 4.7 | 0.30 | 45 | 214 | 132 | $1.0 \times 10^{10}$ |
| 47 | 47 | | 31.5 | 4.8 | 0.30 | 45 | 198 | 157 | $5.0 \times 10^{12}$ |
| 48 | 48 | | 34.5 | 4.9 | 0.30 | 51 | 214 | 132 | $9.0 \times 10^{9}$ |
| 49 | 49 | | 35.7 | 5.1 | 0.30 | 55 | 224 | 115 | $1.0 \times 10^{8}$ |
| 50 | 50 | | 35.9 | 5.1 | 0.30 | 55 | 214 | 132 | $1.0 \times 10^{10}$ |
| 51 | 51 | | 36.5 | 5.0 | 0.30 | 55 | 198 | 157 | $5.0 \times 10^{12}$ |
| 52 | 52 | | 72.4 | 4.8 | 0.13 | 45 | 220 | 122 | $1.0 \times 10^{8}$ |
| 53 | 53 | | 72.6 | 4.8 | 0.13 | 45 | 214 | 132 | $2.0 \times 10^{10}$ |
| 54 | 54 | | 72.2 | 4.8 | 0.13 | 45 | 198 | 157 | $5.0 \times 10^{12}$ |
| 55 | 55 | | 80.2 | 4.8 | 0.13 | 50 | 214 | 132 | $9.0 \times 10^{9}$ |
| 56 | 56 | | 82.8 | 5.1 | 0.13 | 55 | 220 | 122 | $1.0 \times 10^{8}$ |
| 57 | 67 | | 82.4 | 5.1 | 0.13 | 55 | 214 | 132 | $9.0 \times 10^{9}$ |
| 58 | 58 | | 84.6 | 5.0 | 0.13 | 55 | 198 | 157 | $4.0 \times 10^{12}$ |
| 59 | 59 | | 58.8 | 4.8 | 0.16 | 45 | 220 | 122 | $1.0 \times 10^{8}$ |
| 60 | 60 | | 59.0 | 4.8 | 0.16 | 45 | 214 | 132 | $1.0 \times 10^{10}$ |

TABLE 3

| Electro-photographic photosensitive member | Coating solution for conductive layer | Metal oxide particle Kind | A [$m^2/g$] | ρ [$g/cm^3$] | D [μm] | A × ρ × D | Amount [parts] | Binder material (phenol resin) Amount [parts] (resin solid content is 60% by mass of amount below) | Volume resistivity of conductive layer [Ω · cm] |
|---|---|---|---|---|---|---|---|---|---|
| 61 | 61 | Titanium | 59.1 | 4.8 | 0.16 | 45 | 198 | 157 | $4.0 \times 10^{12}$ |
| 62 | 62 | oxide | 66.0 | 4.8 | 0.16 | 51 | 214 | 132 | $1.0 \times 10^{10}$ |
| 63 | 63 | particle | 67.0 | 5.1 | 0.16 | 55 | 224 | 115 | $1.0 \times 10^{8}$ |
| 64 | 64 | coated with | 68.4 | 5 | 0.16 | 55 | 214 | 132 | $9.0 \times 10^{9}$ |
| 65 | 65 | tin oxide | 68.7 | 5 | 0.16 | 55 | 198 | 157 | $5.0 \times 10^{12}$ |
| 66 | 66 | doped with | 42.6 | 4.8 | 0.22 | 45 | 220 | 122 | $1.0 \times 10^{8}$ |
| 67 | 67 | phosphorus | 43.0 | 4.8 | 0.22 | 45 | 207 | 144 | $8.0 \times 10^{10}$ |
| 68 | 68 | | 42.9 | 4.8 | 0.22 | 45 | 198 | 157 | $5.0 \times 10^{12}$ |
| 69 | 69 | | 46.5 | 4.7 | 0.22 | 48 | 207 | 144 | $1.0 \times 10^{11}$ |
| 70 | 70 | | 46.0 | 4.8 | 0.22 | 49 | 212 | 136 | $1.0 \times 10^{10}$ |
| 71 | 71 | | 50.6 | 4.9 | 0.22 | 55 | 220 | 122 | $1.0 \times 10^{8}$ |
| 72 | 72 | | 48.8 | 5.1 | 0.22 | 55 | 214 | 132 | $1.0 \times 10^{10}$ |
| 73 | 73 | | 49.9 | 5 | 0.22 | 55 | 198 | 157 | $5.0 \times 10^{12}$ |
| 74 | 74 | | 37.2 | 4.8 | 0.25 | 45 | 220 | 122 | $1.0 \times 10^{8}$ |
| 75 | 75 | | 37.4 | 4.8 | 0.25 | 45 | 214 | 132 | $2.0 \times 10^{10}$ |
| 76 | 76 | | 38.0 | 4.7 | 0.25 | 45 | 198 | 157 | $5.0 \times 10^{12}$ |
| 77 | 77 | | 38.0 | 4.9 | 0.25 | 47 | 214 | 132 | $2.0 \times 10^{10}$ |
| 78 | 78 | | 40.5 | 4.8 | 0.25 | 49 | 214 | 132 | $1.0 \times 10^{10}$ |
| 79 | 79 | | 42.0 | 5.2 | 0.25 | 55 | 224 | 115 | $1.0 \times 10^{8}$ |
| 80 | 80 | | 42.2 | 5.2 | 0.25 | 55 | 212 | 136 | $1.0 \times 10^{10}$ |
| 81 | 81 | | 42.0 | 5.2 | 0.25 | 55 | 198 | 157 | $5.0 \times 10^{12}$ |

TABLE 4

| Electro-photographic photosensitive member | Coating solution for conductive layer | Metal oxide particle Kind | A [$m^2/g$] | ρ [$g/cm^3$] | D [μm] | A × ρ × D | Amount [parts] | Binder material (phenol resin) Amount [parts] (resin solid content is 60% by mass of amount below) | Volume resistivity of conductive layer [Ω · cm] |
|---|---|---|---|---|---|---|---|---|---|
| C1 | C1 | Titanium | 65.2 | 4.5 | 0.10 | 29 | 214 | 132 | $2.0 \times 10^{10}$ |
| C2 | C2 | oxide | 22.2 | 4.6 | 0.30 | 31 | 214 | 132 | $4.0 \times 10^{10}$ |
| C3 | C3 | particle | 87.0 | 4.5 | 0.10 | 39 | 224 | 115 | $1.0 \times 10^{8}$ |
| C4 | C4 | coated with | 83.6 | 4.6 | 0.10 | 38 | 214 | 132 | $2.0 \times 10^{10}$ |
| C5 | C5 | tin oxide | 89.6 | 4.3 | 0.10 | 39 | 214 | 132 | $2.0 \times 10^{10}$ |
| C6 | C6 | doped with | 84.9 | 4.6 | 0.10 | 39 | 202 | 153 | $5.0 \times 10^{12}$ |
| C7 | C7 | phosphorus | 30.6 | 4.8 | 0.27 | 40 | 220 | 122 | $1.0 \times 10^{8}$ |
| C8 | C8 | | 30.2 | 4.9 | 0.27 | 40 | 207 | 144 | $2.0 \times 10^{10}$ |
| C9 | C9 | | 30.5 | 4.8 | 0.27 | 40 | 202 | 153 | $5.0 \times 10^{12}$ |
| C10 | C10 | | 29.4 | 4.5 | 0.30 | 40 | 220 | 122 | $1.0 \times 10^{8}$ |
| C11 | C11 | | 29.2 | 4.5 | 0.30 | 39 | 212 | 136 | $3.0 \times 10^{10}$ |
| C12 | C12 | | 30.0 | 4.3 | 0.30 | 39 | 214 | 132 | $1.0 \times 10^{10}$ |
| C13 | C13 | | 29.1 | 4.5 | 0.30 | 39 | 202 | 153 | $5.0 \times 10^{12}$ |
| C14 | C14 | | 89.4 | 4.7 | 0.10 | 42 | 224 | 115 | $4.0 \times 10^{7}$ |
| C15 | C15 | | 89.5 | 4.7 | 0.10 | 42 | 195 | 163 | $3.0 \times 10^{13}$ |
| C16 | C16 | | 30.0 | 4.7 | 0.30 | 42 | 224 | 115 | $4.0 \times 10^{7}$ |
| C17 | C17 | | 29.8 | 4.7 | 0.30 | 42 | 195 | 163 | $3.0 \times 10^{13}$ |
| C18 | C18 | | 39.1 | 4.7 | 0.16 | 29 | 212 | 136 | $2.0 \times 10^{10}$ |
| C19 | C19 | | 30.5 | 4.7 | 0.22 | 32 | 214 | 132 | $2.0 \times 10^{10}$ |
| C20 | C20 | | 51.1 | 4.8 | 0.16 | 39 | 214 | 132 | $2.0 \times 10^{10}$ |
| C21 | C21 | | 55.0 | 4.4 | 0.16 | 39 | 214 | 132 | $1.0 \times 10^{10}$ |
| C22 | C22 | | 37.5 | 4.8 | 0.22 | 40 | 214 | 132 | $9.0 \times 10^{9}$ |
| C23 | C23 | | 40.7 | 4.4 | 0.22 | 39 | 212 | 136 | $1.0 \times 10^{10}$ |
| C24 | C24 | | 128.2 | 5.0 | 0.10 | 64 | 224 | 115 | $4.0 \times 10^{7}$ |
| C25 | C25 | | 127.0 | 5.1 | 0.10 | 65 | 195 | 163 | $3.0 \times 10^{13}$ |
| C26 | C26 | | 44.1 | 4.9 | 0.30 | 65 | 224 | 115 | $4.0 \times 10^{7}$ |
| C27 | C27 | | 43.8 | 4.9 | 0.30 | 64 | 195 | 163 | $3.0 \times 10^{13}$ |
| C28 | C28 | | 57.5 | 4.6 | 0.16 | 42 | 224 | 115 | $3.0 \times 10^{7}$ |
| C29 | C29 | | 57.1 | 4.6 | 0.16 | 42 | 195 | 163 | $4.0 \times 10^{13}$ |
| C30 | C30 | | 41.0 | 4.7 | 0.22 | 42 | 224 | 115 | $3.0 \times 10^{7}$ |

TABLE 5

| Electro-photographic photosensitive member | Coating solution for conductive layer | Metal oxide particle Kind | A [$m^2/g$] | ρ [$g/cm^3$] | D [μm] | A × ρ × D | Amount [parts] | Binder material (phenol resin) Amount [parts] (resin solid content is 60% by mass of amount below) | Volume resistivity of conductive layer [Ω · cm] |
|---|---|---|---|---|---|---|---|---|---|
| C31 | C31 | Titanium | 40.6 | 4.7 | 0.22 | 42 | 195 | 163 | $4.0 \times 10^{13}$ |
| C32 | C32 | oxide | 62.2 | 4.8 | 0.16 | 48 | 224 | 115 | $1.0 \times 10^{7}$ |
| C33 | C33 | particle | 61.2 | 4.8 | 0.16 | 47 | 195 | 163 | $5.0 \times 10^{13}$ |
| C34 | C34 | coated with | 45.1 | 4.8 | 0.22 | 48 | 224 | 115 | $1.0 \times 10^{7}$ |
| C35 | C35 | tin oxide | 44.6 | 4.9 | 0.22 | 48 | 195 | 163 | $5.0 \times 10^{13}$ |
| C36 | C36 | doped with | 81.1 | 5.0 | 0.16 | 65 | 224 | 115 | $1.0 \times 10^{7}$ |
| C37 | C37 | phosphorus | 81.0 | 5.0 | 0.16 | 65 | 195 | 163 | $5.0 \times 10^{13}$ |
| C38 | C38 | | 58.0 | 5.0 | 0.22 | 64 | 224 | 115 | $1.0 \times 10^{7}$ |
| C39 | C39 | | 58.9 | 5.0 | 0.22 | 65 | 195 | 163 | $5.0 \times 10^{13}$ |
| C40 | C40 | | 131.1 | 5.2 | 0.10 | 68 | 220 | 122 | $1.0 \times 10^{8}$ |
| C41 | C41 | | 133.8 | 5.1 | 0.10 | 68 | 195 | 163 | $2.0 \times 10^{10}$ |
| C42 | C42 | | 127.2 | 5.3 | 0.10 | 67 | 220 | 122 | $2.0 \times 10^{10}$ |
| C43 | C43 | | 131.0 | 5.2 | 0.10 | 68 | 195 | 163 | $5.0 \times 10^{12}$ |
| C44 | C44 | | 45.5 | 5.0 | 0.30 | 68 | 220 | 122 | $1.0 \times 10^{8}$ |
| C45 | C45 | | 46.5 | 4.9 | 0.30 | 68 | 214 | 132 | $2.0 \times 10^{10}$ |
| C46 | C46 | | 43.8 | 5.2 | 0.30 | 68 | 214 | 132 | $1.0 \times 10^{10}$ |
| C47 | C47 | | 45.1 | 5.0 | 0.30 | 68 | 220 | 122 | $5.0 \times 10^{12}$ |
| C48 | C48 | | 84.3 | 5.0 | 0.16 | 67 | 214 | 132 | $1.0 \times 10^{10}$ |
| C49 | C49 | | 81.2 | 5.2 | 0.16 | 68 | 212 | 136 | $1.0 \times 10^{10}$ |
| C50 | C50 | | 62.1 | 5.0 | 0.22 | 68 | 214 | 132 | $2.0 \times 10^{10}$ |
| C51 | C51 | | 59.0 | 5.2 | 0.22 | 67 | 212 | 136 | $2.0 \times 10^{10}$ |
| C52 | C52 | Titanium | 23.7 | 4.6 | 0.21 | 23 | 207 | 144 | $1.0 \times 10^{10}$ |
| C53 | C53 | oxide | 21.6 | 4.6 | 0.21 | 21 | 207 | 144 | $1.0 \times 10^{10}$ |
| C54 | C54 | particle coated with oxygen-defective tin oxide | 19.9 | 4.4 | 0.23 | 20 | 207 | 144 | $2.0 \times 10^{10}$ |
| C55 | C55 | Barium | 38.3 | 4.7 | 0.10 | 18 | 212 | 136 | $3.0 \times 10^{10}$ |
| C56 | C56 | sulfate | 34.5 | 5.3 | 0.10 | 18 | 212 | 136 | $1.0 \times 10^{10}$ |
| C57 | C57 | particle | 24.6 | 4.6 | 0.15 | 17 | 214 | 132 | $1.0 \times 10^{10}$ |
| C58 | C58 | coated with | 21.0 | 5.3 | 0.15 | 17 | 209 | 140 | $1.0 \times 10^{10}$ |
| C59 | C59 | tin oxide | 9.8 | 4.7 | 0.30 | 14 | 209 | 140 | $3.0 \times 10^{10}$ |
| C60 | C60 | doped with phosphorus | 10.1 | 5.2 | 0.30 | 16 | 209 | 140 | $3.0 \times 10^{10}$ |

Examples 1 to 63, Reference Examples 1 to 18, and Comparative Examples 1 to 60

Each of the electrophotographic photosensitive members 1 to 81 and C1 to C60 was mounted on a laser beam printer (trade name: Laserjet P1006) made by Hewlett-Packard Company, and a sheet feeding durability test was performed under a high temperature and high humidity (32.5° C./80% RH) environment to evaluate an image. In the sheet feeding durability test, a text image having a coverage rate of 2% was printed on a letter size sheet one by one in an intermittent mode, and 2200 sheets of the image were output. After that, the toner for the laser beam printer was replenished, and 1100 sheets of the image were further output (3300 sheets in total).

Then, a sheet of a sample for image evaluation (hafltone image of one dot KEIMA pattern) was output every time when the sheet feeding durability test was started, when 700 sheets of the image were output, when 1400 sheets of the image were output, when 2200 sheets of the image were output, and when 3300 sheets of the image were output.

In the output halftone images, the number and size of defects (black spots) on the image corresponding to one rotation of the electrophotographic photosensitive member were observed visually and with a loupe. Based on the number and size of the black spots observed, the image was evaluated on the following criterion. The result is shown in Tables 6 to 10.

A: the number of black spots is 0.

B: 1 to 3 black spots having a diameter of less than 0.4 mm and no black spots having a diameter of not less than 0.4 mm.

C: 4 to 7 black spots having a diameter of less than 0.4 mm. Or 0 to 3 black spots having a diameter of less than 0.4 mm and one black spot having a diameter of not less than 0.4 mm.

D: 8 or more black spots having a diameter of less than 0.4 mm. Or 0 to 7 black spots having a diameter of less than 0.4 mm and 2 or more black spots having a diameter not less than 0.4 mm.

Other than the electrophotographic photosensitive members 1 to 81 and C1 to C60 subjected to the sheet feeding durability test, another set of the electrophotographic photosensitive members 1 to 81 and C1 to C60 was prepared, and the same sheet feeding durability test as above was performed under a low temperature and low humidity (15° C./10% RH) environment. The charge potential (dark area potential) and the potential during exposure (light area potential) were measured when the sheet feeding durability test was started and after 2200 sheets of the image were output. The measurement of the potential was performed using one white solid image and one black solid image. The dark area potential at the initial stage (when the sheet feeding durability test was started) was Vd, and the light area potential at the initial stage (when the sheet feeding durability test was started) was Vl. The dark area potential after 2200 sheets of the image were output was Vd', and the light area potential after 2200 sheets of the image were output was Vl'. The difference between the dark area potential Vd' after 2200 sheets of the image were output and the dark area potential Vd at the initial stage, i.e., the amount of the dark area potential to be changed ΔVd (=|Vd'|−|Vd|) was determined. Moreover, the difference between the light area potential Vl' after 2200 sheets of the image were output and the light area potential Vl at the initial stage, i.e., the amount of the light area potential to be changed ΔVl (=|Vl'|−|Vl|) was determined. The result is shown in Tables 6 to 10.

TABLE 6

| | Electro-photographic photosensitive member | Black spots: When sheet feeding durability test is started | When 700 sheets of image are output | When 1400 sheets of image are output | When 2200 sheets of image are output | When 3300 sheets of image are output | Amount of potential to be changed [V] ΔVd | ΔVl |
|---|---|---|---|---|---|---|---|---|
| Reference Example 1 | 1 | B | B | B | B | C | +11 | +26 |
| Reference Example 2 | 2 | B | B | B | B | C | +12 | +29 |
| Reference Example 3 | 3 | B | B | B | B | C | +11 | +30 |
| Example 1 | 4 | A | B | B | B | B | +12 | +29 |
| Example 2 | 5 | A | B | B | B | B | +13 | +28 |
| Example 3 | 6 | A | B | B | B | B | +13 | +34 |
| Reference Example 4 | 7 | B | B | B | B | C | +14 | +26 |
| Reference Example 5 | 8 | B | B | B | B | C | +11 | +30 |
| Reference Example 6 | 9 | B | B | B | B | C | +13 | +30 |
| Example 4 | 10 | A | B | B | B | B | +14 | +29 |
| Example 5 | 11 | A | B | B | B | B | +11 | +28 |
| Example 6 | 12 | B | B | B | B | B | +14 | +32 |
| Reference Example 7 | 13 | A | B | B | B | C | +12 | +28 |
| Reference Example 8 | 14 | A | B | B | B | C | +13 | +27 |
| Reference Example 9 | 15 | A | B | B | B | C | +13 | +30 |
| Example 7 | 16 | A | B | B | B | B | +11 | +25 |
| Example 8 | 17 | B | B | B | B | B | +12 | +28 |
| Example 9 | 18 | A | B | B | B | B | +12 | +31 |
| Reference Example 10 | 19 | A | B | B | B | C | +12 | +25 |
| Reference Example 11 | 20 | A | B | B | B | C | +13 | +28 |
| Reference Example 12 | 21 | A | B | B | B | C | +15 | +30 |
| Example 10 | 22 | A | B | B | B | B | +11 | +29 |
| Example 11 | 23 | A | B | B | B | B | +14 | +30 |
| Example 12 | 24 | A | B | B | B | B | +11 | +36 |
| Reference Example 13 | 25 | A | B | B | B | C | +13 | +28 |
| Reference Example 14 | 26 | A | B | B | B | C | +12 | +28 |
| Reference Example 15 | 27 | A | B | B | B | C | +12 | +33 |
| Example 13 | 28 | A | A | B | B | B | +14 | +28 |
| Example 14 | 29 | A | B | B | B | B | +11 | +28 |
| Example 15 | 30 | A | B | B | B | B | +11 | +24 |

TABLE 7

| | Electro-photographic photosensitive member | Black spots: When sheet feeding durability test is started | When 700 sheets of image are output | When 1400 sheets of image are output | When 2200 sheets of image are output | When 3300 sheets of image are output | Amount of potential to be changed [V] ΔVd | ΔVl |
|---|---|---|---|---|---|---|---|---|
| Example 16 | 31 | A | B | B | B | B | +12 | +28 |
| Reference Example 16 | 32 | A | B | B | B | C | +11 | +29 |
| Reference Example 17 | 33 | A | B | B | B | C | +13 | +25 |
| Reference Example 18 | 34 | A | B | B | B | C | +13 | +28 |
| Example 17 | 35 | A | B | B | B | B | +13 | +25 |
| Example 18 | 36 | A | B | B | B | B | +11 | +29 |
| Example 19 | 37 | A | B | B | B | B | +11 | +27 |
| Example 20 | 38 | A | A | A | B | B | +11 | +29 |
| Example 21 | 39 | A | A | A | B | B | +13 | +29 |
| Example 22 | 40 | A | A | A | B | B | +13 | +33 |
| Example 23 | 41 | A | A | A | B | B | +11 | +28 |
| Example 24 | 42 | A | A | A | B | B | +15 | +27 |
| Example 25 | 43 | A | A | A | B | B | +13 | +28 |
| Example 26 | 44 | A | A | A | B | B | +14 | +29 |
| Example 27 | 45 | A | A | A | B | B | +14 | +28 |
| Example 28 | 46 | A | A | A | B | B | +13 | +27 |
| Example 29 | 47 | A | A | A | B | B | +11 | +34 |
| Example 30 | 48 | A | A | A | B | B | +11 | +28 |
| Example 31 | 49 | A | A | A | B | B | +12 | +31 |
| Example 32 | 50 | A | A | A | B | B | +12 | +31 |
| Example 33 | 51 | A | A | A | B | B | +13 | +33 |
| Example 34 | 52 | A | A | A | A | A | +11 | +28 |

TABLE 7-continued

| | Electro-photographic photosensitive member | Black spots: When sheet feeding durability test is started | When 700 sheets of image are output | When 1400 sheets of image are output | When 2200 sheets of image are output | When 3300 sheets of image are output | Amount of potential to be changed [V] ΔVd | ΔVl |
|---|---|---|---|---|---|---|---|---|
| Example 35 | 53 | A | A | A | A | A | +12 | +26 |
| Example 36 | 54 | A | A | A | A | A | +13 | +33 |
| Example 37 | 55 | A | A | A | A | A | +11 | +28 |
| Example 38 | 56 | A | A | A | A | A | +14 | +28 |
| Example 39 | 57 | A | A | A | A | A | +11 | +29 |
| Example 40 | 58 | A | A | A | A | A | +14 | +31 |
| Example 41 | 59 | A | A | A | A | A | +11 | +28 |
| Example 42 | 60 | A | A | A | A | A | +11 | +30 |

TABLE 8

| | Electro-photographic photosensitive member | Black spots: When sheet feeding durability test is started | When 700 sheets of image are output | When 1400 sheets of image are output | When 2200 sheets of image are output | When 3300 sheets of image are output | Amount of potential to be changed [V] ΔVd | ΔVl |
|---|---|---|---|---|---|---|---|---|
| Example 43 | 61 | A | A | A | A | A | +12 | +33 |
| Example 44 | 62 | A | A | A | A | A | +14 | +28 |
| Example 45 | 63 | A | A | A | A | A | +13 | +28 |
| Example 46 | 64 | A | A | A | A | A | +13 | +28 |
| Example 47 | 65 | A | A | A | A | A | +12 | +33 |
| Example 48 | 66 | A | A | A | A | A | +13 | +28 |
| Example 49 | 67 | A | A | A | A | A | +12 | +29 |
| Example 50 | 68 | A | A | A | A | A | +14 | +30 |
| Example 51 | 69 | A | A | A | A | A | +13 | +28 |
| Example 52 | 70 | A | A | A | A | A | +13 | +25 |
| Example 53 | 71 | A | A | A | A | A | +11 | +29 |
| Example 54 | 72 | A | A | A | A | A | +11 | +27 |
| Example 55 | 73 | A | A | A | A | A | +11 | +37 |
| Example 56 | 74 | A | A | A | A | A | +13 | +28 |
| Example 57 | 75 | A | A | A | A | A | +13 | +29 |
| Example 58 | 76 | A | A | A | A | A | +11 | +33 |
| Example 59 | 77 | A | A | A | A | A | +14 | +27 |
| Example 60 | 78 | A | A | A | A | A | +13 | +29 |
| Example 61 | 79 | A | A | A | A | A | +12 | +29 |
| Example 62 | 80 | A | A | A | A | A | +12 | +29 |
| Example 63 | 81 | A | A | A | A | A | +11 | +33 |

TABLE 9

| | Electro-photographic photosensitive member | Black spots: When sheet feeding durability test is started | When 700 sheets of image are output | When 1400 sheets of image are output | When 2200 sheets of image are output | When 3300 sheets of image are output | Amount of potential to be changed [V] ΔVd | ΔVl |
|---|---|---|---|---|---|---|---|---|
| Comparative Example 1 | C1 | C | C | D | D | D | +11 | +29 |
| Comparative Example 2 | C2 | C | D | D | C | D | +12 | +29 |
| Comparative Example 3 | C3 | B | B | C | D | D | +13 | +28 |
| Comparative Example 4 | C4 | B | B | C | D | D | +14 | +28 |
| Comparative Example 5 | C5 | B | B | C | D | D | +12 | +30 |
| Comparative Example 6 | C6 | B | B | C | D | D | +11 | +32 |
| Comparative Example 7 | C7 | B | B | C | D | D | +15 | +30 |
| Comparative Example 8 | C8 | B | B | C | D | D | +12 | +25 |
| Comparative Example 9 | C9 | B | B | C | C | D | +13 | +33 |
| Comparative Example 10 | C10 | B | B | C | D | D | +13 | +31 |
| Comparative Example 11 | C11 | B | B | C | D | D | +12 | +26 |
| Comparative Example 12 | C12 | B | B | C | D | D | +12 | +25 |
| Comparative Example 13 | C13 | B | B | C | D | D | +11 | +31 |

TABLE 9-continued

| | Electro-photographic photosensitive member | Black spots: When sheet feeding durability test is started | When 700 sheets of image are output | When 1400 sheets of image are output | When 2200 sheets of image are output | When 3300 sheets of image are output | Amount of potential to be changed [V] ΔVd | ΔVl |
|---|---|---|---|---|---|---|---|---|
| Comparative Example 14 | C14 | B | C | D | D | D | +11 | +27 |
| Comparative Example 15 | C15 | B | B | B | B | C | +12 | +56 |
| Comparative Example 16 | C16 | C | C | C | C | D | +13 | +30 |
| Comparative Example 17 | C17 | B | B | B | B | C | +12 | +56 |
| Comparative Example 18 | C18 | B | C | C | C | D | +12 | +30 |
| Comparative Example 19 | C19 | C | C | D | D | D | +12 | +28 |
| Comparative Example 20 | C20 | B | B | C | C | D | +11 | +26 |
| Comparative Example 21 | C21 | B | B | C | C | D | +14 | +27 |
| Comparative Example 22 | C22 | B | B | C | C | D | +14 | +30 |
| Comparative Example 23 | C23 | B | B | C | C | D | +11 | +29 |
| Comparative Example 24 | C24 | C | C | C | C | C | +15 | +29 |
| Comparative Example 25 | C25 | A | B | B | B | B | +13 | +58 |
| Comparative Example 26 | C26 | C | C | C | C | C | +11 | +30 |
| Comparative Example 27 | C27 | A | B | B | B | B | +14 | +57 |
| Comparative Example 28 | C28 | B | C | C | C | D | +11 | +32 |
| Comparative Example 29 | C29 | A | B | B | B | B | +11 | +59 |
| Comparative Example 30 | C30 | C | C | C | C | D | +15 | +30 |

TABLE 10

| | Electro-photographic photosensitive member | Black spots: When sheet feeding durability test is started | When 700 sheets of image are output | When 1400 sheets of image are output | When 2200 sheets of image are output | When 3300 sheets of image are output | Amount of potential to be changed [V] ΔVd | ΔVl |
|---|---|---|---|---|---|---|---|---|
| Comparative Example 31 | C31 | A | B | B | B | C | +13 | +60 |
| Comparative Example 32 | C32 | C | C | C | C | C | +13 | +29 |
| Comparative Example 33 | C33 | A | B | B | B | B | +13 | +60 |
| Comparative Example 34 | C34 | B | C | C | C | C | +12 | +28 |
| Comparative Example 35 | C35 | A | B | B | B | B | +12 | +57 |
| Comparative Example 36 | C36 | C | C | C | C | C | +12 | +32 |
| Comparative Example 37 | C37 | A | B | B | B | B | +14 | +59 |
| Comparative Example 38 | C38 | C | C | C | C | C | +11 | +29 |
| Comparative Example 39 | C39 | A | B | B | B | B | +12 | +62 |
| Comparative Example 40 | C40 | B | C | C | D | D | +13 | +26 |
| Comparative Example 41 | C41 | B | B | C | C | C | +15 | +27 |
| Comparative Example 42 | C42 | B | B | C | C | C | +13 | +27 |
| Comparative Example 43 | C43 | B | B | C | C | C | +14 | +30 |
| Comparative Example 44 | C44 | B | C | C | C | C | +13 | +27 |
| Comparative Example 45 | C45 | B | B | C | C | C | +13 | +27 |
| Comparative Example 46 | C46 | B | B | C | C | C | +13 | +31 |
| Comparative Example 47 | C47 | B | B | C | C | C | +14 | +32 |
| Comparative Example 48 | C48 | B | B | C | C | C | +12 | +28 |
| Comparative Example 49 | C49 | B | B | C | C | C | +13 | +29 |
| Comparative Example 50 | C50 | B | B | C | C | C | +12 | +27 |
| Comparative Example 51 | C51 | B | B | C | C | C | +12 | +27 |
| Comparative Example 52 | C52 | B | C | C | C | D | +13 | +28 |
| Comparative Example 53 | C53 | B | C | C | C | D | +13 | +29 |
| Comparative Example 54 | C54 | B | C | C | C | D | +13 | +31 |
| Comparative Example 55 | C55 | C | C | D | D | D | +12 | +28 |
| Comparative Example 56 | C56 | C | C | D | D | D | +12 | +33 |
| Comparative Example 57 | C57 | C | C | D | D | D | +12 | +32 |
| Comparative Example 58 | C58 | C | C | D | D | D | +14 | +31 |
| Comparative Example 59 | C59 | C | D | D | D | D | +12 | +29 |
| Comparative Example 60 | C60 | C | D | D | D | D | +13 | +34 |

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2011-046517, filed Mar. 3, 2011, Japanese Patent Application No. 2011-215136, filed Sep. 29, 2011, and Japanese Patent Application No. 2012-039016, filed Feb. 24, 2012, which are hereby incorporated by reference herein in their entirety.

What is claimed is:

1. A method for producing an electrophotographic photosensitive member, comprising: a step of forming a conductive layer having a volume resistivity of not less than $1.0\times10^{8}\Omega\cdot cm$ but not more than $5.0\times10^{12}\Omega\cdot cm$ on a support; and a step of forming a photosensitive layer on the conductive layer, wherein the step of forming the conductive layer comprises:

(i) preparing a coating liquid for a conductive layer using a solvent, a binder material, and a metal oxide particle that satisfies the following relation (i):

$$45\leqq A\times\rho\times D\leqq 65 \quad \text{(i)}$$

wherein A denotes a surface area of the metal oxide particle per unit mass [$m^2/g$], D denotes a number average particle diameter of the metal oxide particle [μm], and ρ denotes a density of the metal oxide particle [$g/cm^3$]; and (ii) forming the conductive layer using the coating liquid for a conductive layer, and the metal oxide particle is a titanium oxide particle coated with tin oxide doped with phosphorus.

2. The method for producing an electrophotographic photosensitive member according to claim 1, wherein the metal oxide particle satisfies $0.13\leqq D\leqq 0.25$.

3. The method for producing an electrophotographic photosensitive member according to claim 1, wherein the metal oxide particle satisfies $45\leqq A\times\rho\times D\leqq 55$.

* * * * *